US009822939B2

(12) United States Patent
Krause

(10) Patent No.: US 9,822,939 B2
(45) Date of Patent: Nov. 21, 2017

(54) RECONFIGURABLE CORNACE BOX DISPLAY SYSTEM

(71) Applicant: Gary R. Krause, Livonia, MI (US)

(72) Inventor: Gary R. Krause, Livonia, MI (US)

( * ) Notice: Subject to any disclaimer, the term of this patent is extended or adjusted under 35 U.S.C. 154(b) by 0 days.

(21) Appl. No.: 15/052,841

(22) Filed: Feb. 24, 2016

(65) Prior Publication Data

US 2017/0241602 A1 Aug. 24, 2017

(51) Int. Cl.

| | |
|---|---|
| ***F21S 8/00*** | (2006.01) |
| ***F21V 19/00*** | (2006.01) |
| ***F21S 9/03*** | (2006.01) |
| ***F21V 7/04*** | (2006.01) |
| ***F21V 21/096*** | (2006.01) |
| *F21Y 115/10* | (2016.01) |

(52) U.S. Cl.

CPC ..... *F21S 8/036* (2013.01); *F21S 9/032* (2013.01); *F21V 7/04* (2013.01); *F21V 19/001* (2013.01); *F21V 21/096* (2013.01); *F21Y 2115/10* (2016.08)

(58) Field of Classification Search

CPC ..... F21S 8/04; F21S 8/033; F21S 8/02
USPC ..... 362/151
See application file for complete search history.

(56) References Cited

U.S. PATENT DOCUMENTS

| | | | | |
|---|---|---|---|---|
| 2,243,222 | A | 5/1941 | Rebholz | |
| 2,315,033 | A | 3/1943 | Adair | |
| 2,375,247 | A | 5/1945 | Rebholz | |
| 2,415,330 | A | 2/1947 | Bashwiner | |
| 2,501,133 | A | 3/1950 | Levy | |
| 2,539,380 | A | 1/1951 | Zimmermann | |
| 2,602,500 | A | 7/1952 | Slavin et al. | |
| 2,862,549 | A | 12/1958 | Robbins | |
| 2,894,571 | A | 12/1959 | Toti | |
| 5,032,958 | A * | 7/1991 | Harwood | F21V 7/005 362/217.06 |
| 5,384,519 | A | 1/1995 | Gotoh | |
| 5,484,006 | A | 1/1996 | Walker | |
| 6,603,271 | B2 | 8/2003 | Noh | |
| 6,877,545 | B1 | 4/2005 | Parkerson | |
| 7,227,668 | B2 | 6/2007 | Paul | |

(Continued)

*Primary Examiner* — Jamara Franklin
(74) *Attorney, Agent, or Firm* — J. Gordon Lewis

(57) ABSTRACT

A reconfigurable modular cornice box display system includes a cornice box having a front member, a left member and a right member which collectively form an outwardly facing display surface. One or more décor pieces can be selectively positioned and magnetically affixed anywhere on the display surface. The décor pieces are magnetically affixed to discrete elements arrayed in the cornice box. A décor piece illumination system includes a tri-color back light source and a magnetic sensor associated with each of said discrete elements operative to sense the magnetic coupling of a given décor piece to a given discrete element and to back illuminate said given décor piece. An electronic control system selectively activates the décor piece illumination system in response to operator inputs and microprocessor based programming instructions. A flood light assembly is disposed within said cornice box which is longitudinally and rotationally repositionable. The light sources are tri-color devices.

19 Claims, 6 Drawing Sheets

(56) References Cited

U.S. PATENT DOCUMENTS

| | | | | |
|---|---|---|---|---|
| 9,110,291 | B2 | 8/2015 | Dominguez-Caballero et al. | |
| 2010/0181032 | A1* | 7/2010 | Bennett | A47H 2/00 160/330 |

* cited by examiner

RECONFIGURABLE CORNACE BOX DISPLAY SYSTEM

TECHNICAL FIELD

The present invention is related to interior window dressings, and more particularly to reconfigurable interior window dressings.

BACKGROUND OF THE INVENTION in the field of interior decorating cornice or window boxes are used to conceal curtain rods and pins and to provide decorative design and aesthetic appeal to a window. There are several types of cornice boxes currently available. Cornice boxes have traditionally been built from wood. Custom design cornice boxes built by a skilled craftsman, such as a carpenter, generally are expensive and very heavy. The expense of a custom design, all-wood cornice box precludes many people from employing this type of cornice box to decorate windows in their homes or offices.

Another type of wood cornice box can be constructed from a number of discrete laminate or plywood pieces that are pre-formed and provided as a kit. Such discrete pieces may be assembled by gluing or nailing them together to form a pre-designed cornice box. Such wood-kit cornice boxes are also expensive, heavy, may require special tools and assembly fixtures, and sometimes are difficult to assemble.

Lightweight, inexpensive cornice boxes made from Styrofoam or foam board have been offered as an alternative to wood cornice boxes. Styrofoam cornice boxes are less expensive and lighter than all-wood cornice boxes, but do not have sufficient rigidity and durability for use over extended periods of time.

Lightweight, inexpensive cornice boxes formed from cardboard have been offered as an alternative to all-wood and Styrofoam cornice boxes. Unfortunately, such cardboard cornice boxes of the prior art are difficult to assemble and require fastening hardware in order to hold the box together and to mount the box to a wall.

Lighting fixtures of the type known as "cornice" lighting fixtures are typically designed to be mounted above and spaced some finite distance out of a wall surface which it is desired to illuminate. The "cornice" lighting fixture is especially designed to provide uniform illumination or "wash" lighting to the wall being illuminated.

A conventional illumination, lamp generally outputs a single color of light, with a specified, brightness. More recently, there has been a growing tendency to use three lamps that output different wavelengths of light to provide a more natural light projector. However, it is extremely difficult to control the brightness of red (R), green (G) and blue (B) colors of recently developed three-wavelength lamps in accordance with their placement and the subjective tastes of users.

An illumination lamp can be employed which allows a user to perform brightness and color control in accordance with the state and purpose of use, the environment of use, or the tastes of the users. An illumination lamp may include a rectifier configured to rectify a current supplied by a power supply, a ballast portion configured to start the lamp using the power rectified in the rectifier, a lamp portion that is connected to the ballast portion, and that includes a plurality, preferably three, of tubes, each tube outputting a light of a different color temperature, and a controller that is connected to the ballast portion, configured to control a brightness and color of light produced by the illumination lamp.

A search of issued U.S. patents in the field of cornice boxes and related apparatus reveals U.S. patents related generally to the field of the present invention but which do not anticipate nor disclose the device of the present invention. The discovered U.S. patents relating generally to the present invention are discussed herein below.

U.S. Pat. No. 5,484,006 to Walker entitled "Cornice Box" discloses a cornice box assembly for forming a cornice box of a desired shape that hangs on a wall over a window. The assembly includes a face member of a lightweight rigid material and first and second side members of the lightweight rigid material. Additionally, the assembly includes a top member of the lightweight rigid material. A back member is also provided of the lightweight rigid material having a first side tab member at a first end and a second side tab member at a second end. Each tab member may be placed in a position generally perpendicular to the back member at an interface between each tab member and the back member. The assembly also includes an adhesive for joining the members such that a hingeable joint is formed between any two adhesive joined members. The assembly also includes a fastening medium attached to each side member and a connection medium attached to each back side tab member. The fastening and connection mediums come together so as to hold the cornice box in a desired shape when the cornice box is formed along the hingeable joints with the side members and back member being generally perpendicular to the face member and the back member is generally parallel to the face member. A hanging medium attached to the back member's outside surface is also provided for securing the cornice box to the wall.

U.S. Pat. No. 6,877,545 B1 to Parkerson entitled "Foam Cornice Board" discloses a foam cornice board for hanging curtains to a foam body having a decorative front surface defining a flat central portion and decorative upper and lower portions. The central portion is configured is configured to receive a flat strip of decorative material such as a single vertical blind panel. The foam body further includes a notch formed into its back surface along the upper edge for receiving a mounting member connected thereto. For longer spans, a decorative foam keystone connector panel joins two adjacent cornice boards together which are abutted in end-to-end fashion. A decorative foam side cascade with a coextensive side panel is connectable to a wall, the side cascade having an upper margin configured for mating supportive engagement with a lower margin of the cornice board.

U.S. Pat. No. 5,032,958 to Harwood entitled "Cornice Lighting System" discloses a lighting fixture of the wall wash type and being parabolic in cross-section which has interchangeable reflector elements for directing the light in any desired direction with snap-in quickly interchangeable lighting fixtures to provide for the use of fluorescent lighting, tracking lighting, incandescent lighting or the like. The lighting fixtures are adaptable to be "ganged" together seriatim in any number needed to provide for the fixture to be of any desired length. Unique power transformer means can be provided to provide for electrically connecting the joined lighting fixtures.

None of the above listed U.S. patents disclose or suggest a reconfigurable cornice box assembly of the present invention. Each of the above listed U.S. patents (i.e., U.S. Pat. No. 5,484,006; U.S. Pat. No. 6,877,545 B1; and U.S. Pat. No. 5,032,958) are hereby incorporated herein by reference.

SUMMARY OF THE INVENTION

The forgoing problems and limitations are overcome and other advantages are provided by a new and improved reconfigurable cornice box display system which provides flexibility and user convenience for displaying and self-sensing changing objects d'art, focused and flood illumination, automated reconfiguration of valance and window blind structures, self-powering and operator remote control and programmability.

Therefore, it is an object of the present invention to provide a novel reconfigurable cornice box display system.

The present invention provides a reconfigurable modular cornice box display including a cornice box with a front member forming an outwardly facing display surface, at least one décor piece adapted for selective positioning on and releasable affixation to the display surface, and a magnetic coupling system comprising a first element (such as a permanent magnet or a piece of ferrous material) carried with the cornice box and a second element carried with each décor piece, wherein the first element is substantially co-extensive with said outwardly facing display surface to effect magnetic coupling of said décor piece upon any location of said outwardly facing display surface.

According to one aspect of the invention, the first element comprises an array of spaced apart discrete elements embedded within said front member which sufficiently covers the outwardly facing display surface in adequate dimension and placement to ensure that the second element of a décor piece placed anywhere on the display surface will magnetically engage at least one of the first element. This arrangement ensures attachment of a décor piece at any location on the display surface while minimizing overall weight and cost.

According to another aspect of the invention, the reconfigurable modular cornice box display, system includes a décor piece illumination system comprising a back light source and a magnetic sensor associated with each of said discrete elements operative to sense the magnetic coupling of a given décor piece to a given discrete element and to back illuminate the given décor piece in response thereto. The back light system can provide light directed through translucent/transparent portions of a décor piece and/or a halo effect about its perimeter.

According to yet another aspect of the invention, the reconfigurable modular cornice box display system of includes an electronic control system operable to selectively activate said décor piece illumination system in response to remote or local operator inputs and microprocessor based programming instructions. The remote controller or application (APP) for a personal portable electronic device (PPD) can be employed to initiate, cancel or modify various lighting sequences.

According to yet another aspect of the invention, the reconfigurable modular cornice box display system further includes a flood light assembly disposed within said cornice box which is longitudinally and rotationally repositionable.

According to yet another aspect of the invention, the reconfigurable modular cornice box display system, wherein said back light flood light sources further comprises a tri-color light source operable to selectively vary the color of light emitted therefrom.

These and other features and advantages of this invention will become apparent upon reading the following specification, which, along with the drawings, describes preferred and alternative embodiments of the invention in detail.

BRIEF DESCRIPTION OF THE DRAWINGS

The present invention will now be described, by way of example, with reference to the accompanying drawings, in which.

Although the drawings represent embodiments of the present invention, the drawings are not necessarily to scale and certain features may be exaggerated in order to illustrate and explain the present invention. The exemplification set forth herein illustrates an embodiment of the invention, in one form, and such exemplifications are not to be construed as limiting the scope of the invention in any manner.

DESCRIPTION OF THE PREFERRED EMBODIMENTS

Figure 1:
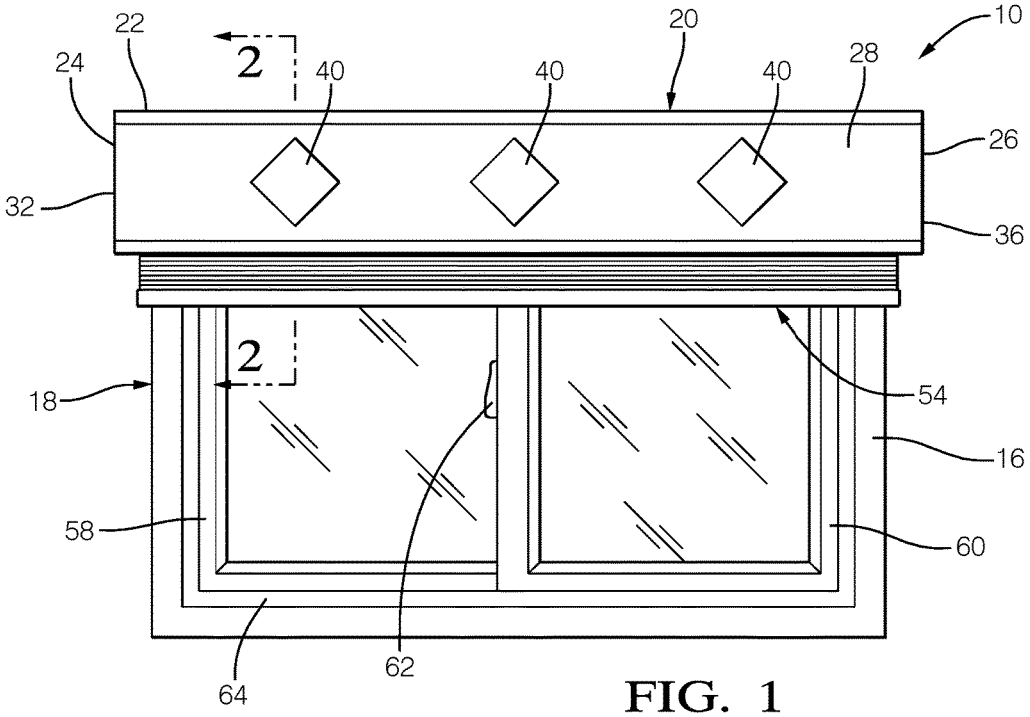
FIG. 1, is a frontal plan view of a reconfigurable cornice box assembly embodying the present invention, applied to an adjacent residential or commercial window structure.

Referring to the drawing figures, and particularly to FIG. 1, a preferred embodiment of a reconfigurable cornice box display system in accordance with the present invention is illustrated in front plan view and generally designated by the reference numeral 10.

The cornice box display system 10 includes a number of features and advantages over prior known devices. The system 10 provides an extension/decorative easy hang feature from an associated wall or window framework, it supports blinds and/or shades of all types. It provides a programmable indirect lighting feature. It holds tension type rods for holding a sheer, drape, valance or the like. The system accommodates varied décor pieces which can be illuminated via a battery with light emitting diode (LED), solar sensor with battery, household system power or wireless power supply. Furthermore, such décor pieces can comprise pins or small rods that can hold external drapery. The system 10 includes wall mount and/or side panel pieces which fold over for packaging and convenient shipping and are hinged or removed and, in application set by an end customer. The system is modular enabling add on decorative pieces at top, bottom and side panels. Furthermore, the modular feature enables addition of decorative pieces with LED lights with embedded and added creative edges of top, bottom and side panels. Lastly, the décor pieces comprise "magnetic adornment art" of two distinct types, solid décor and illuminated décor wherein illumination is provided from lights (e.g., LED lights) in the cornice and/or illumination is built into a décor piece which is self-powered or remotely powered and controlled. The cornice box can be constructed from sheet formed metal/steel (SM), extruded wood pulp, a composite of medium density fiberboard (MDF) and SM, papier mâché and SM, cardboard and SM, plywood and SM, or plank wood (e.g., pine) and SM. The decorations (i.e., magnetic adornment art) can be formed from cardboard, MDF, plywood, plastic, a common base with a lighting source from behind.

The back lights are inserted into the front board in multiple locations. When lights are not illuminated, the board appears not normal. White, or a light pastel color with smooth or textured finish can be applied. The system preferably employs low voltage or transformer reduction of household type current. A remote controller or application (APP) can be employed to two on and off various lighting sequences. The décor pieces can be magnetic and be able to be illuminated from the back from the light source on the board. One mode can be static, meaning once a décor piece is placed for magnetic retention to the display board, then the light behind that décor piece turns on, thus illuminating the décor piece by actuation of a magnetic switch. Other modes of operation allow the lights to be operated in sequences such as, random flashing, color choice, fade in and out, etc. Unique décor piece designs can be employed with the light option board which are still magnetic, but allow light through from light resonating through the décor piece made of some type of material permitting light to pass through it, thus allowing the décor piece to glow on the front side. The light source from the board provides the light for a glow on the décor piece.

Figure 2:
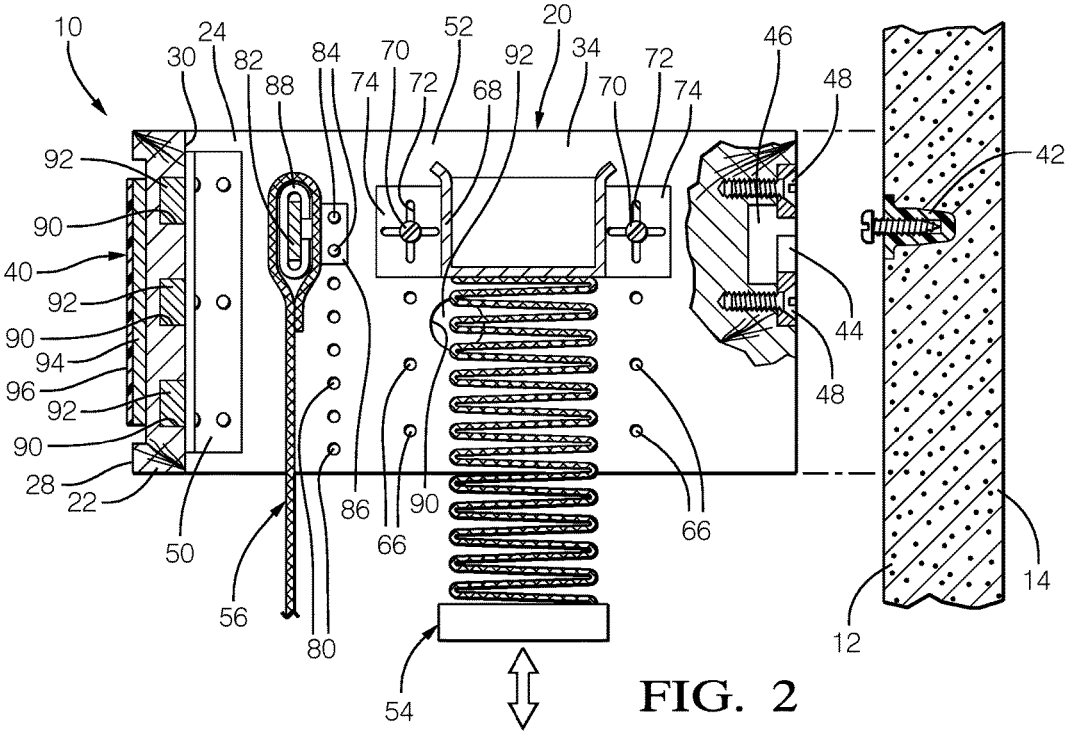
FIG. 2, is a broken, cross-sectional view of the cornice box assembly of FIG. 1 on an enlarged scale and removed from the window structure in exploded view.

Referring to FIGS. 1 and 2, the reconfigurable cornice box display system 10 is typically secured to a vertical support surface 12 defined by a wall 14 or frame structure 16 adjacent an associated window 18. The reconfigurable cornice box display system 10 typically constitutes a window treatment and has multiple features as described herein. The reconfigurable cornice box display system 10 forms a cornice box 20 defining a horizontally elongated front member 22, a longitudinally (rearwardly) extending left side member 24 and a longitudinally extending right side member 24. The front member 22 forms an outwardly facing vertical surface 28 and an inwardly facing vertical surface 30. The left side member 24 forms a leftwardly facing outer vertical surface 32 and a rightwardly facing inner surface 34. Similarly, right side member 26 forms a rightwardly facing outer vertical surface 36 and a leftwardly facing inner surface 38.

A principle feature of the present invention is to easily affix one or more décor pieces 40 at various locations of the outwardly facing surfaces 28, 32 and 36 (e.g., mounting/affixation surfaces), and to selectively reposition the décor pieces at the consumer's preference. This is accomplished by effecting magnetic attachment of each décor piece 40 to one of the mounting surfaces 28, 32 and 36. FIG. 1 illustrates three décor pieces 40 horizontally arranged along mounting surface 28, to establish a desired esthetic effect.

In the embodiment of the invention illustrated in FIGS. 1 and 2, the cornice box 20 is preferably formed of non-ferrous rigid material such as wood, particle board, foam board or the like.

Referring to FIG. 2, the cornice box 20 is affixed to the wall 14 by an anchor bolt assembly 42 which supportingly engages a slot retainer 44 secured over a recess 46 formed in an inner end of the left side member 24 by a pair of wood screws 48. So mounted, the side member 24 extends normally from the support surface 12 formed by the wall 14. The outer end of the left side member 24 is interconnected to the left hand most end of the front member 22 by a vertically extending plano-type hinge 50. The outer end of the right side member 26 is similarly interconnected to the right hand most end of the front member 22 by a second vertically extending plano-type hinge (not illustrated). When in an installed orientation, the front member 22 extends normally to both of said side members 24 and 26, respectively. Prior to installation, the side members 24 and 26 can be deployed parallel to the front member 22 via the hinges 50 to minimize packaging volume and reduce costs of shipment.

The side members 24 and 26 serve to support the front member 22 in a spaced relationship from the support surface 12 of the wall 14 to establish a cavity 52 for mounting blind 54 (e.g., Venetian or accordion type) an well as a decorative valance 56. The cavity 52 is dimensioned to provide adequate clearance spacing between mounting blind 54, valance 56 and elements of the associated window 18 such as fixed/movable panels 58 and 60, handles/lock mechanisms 62 and sills 64.

A plurality of cooperating, spaced apart mounting hole pairs 66 are formed in the inner surfaces 34 and 38 of left and right side members 24 and 26, respectively, with a designated hole pair 66 supporting a blind end mounting bracket 68 via screws 70 extending through "X" or "+" shaped flange openings 72 in cooperating bracket flanges 74. The blind 54 is vertically and longitudinally adjustable by loosening/retightening the screws 70 and repositioning the bracket 68. The blind is further vertically adjustable by relocating the screws 70 and brackets between various mounting hole pairs 66. Once installed, the blind is vertically repositionable (manually or via a power drive mechanism) as indicated by bidirectional arrow 76.

A plurality of cooperating, vertically spaced apart mounting holes 80 are formed in the inner surfaces 34 and 38 of left and right side members 24 and 26, respectively, one or more designated holes 80 supporting a valance end mounting bracket 82 via screws 84 extending through openings in cooperating bracket flanges 86. The valance 56 is supported by a connecting or tension rod 88 extending longitudinally between an opposed pair of mounting brackets 82. The valance 56 is vertically repositionable by relocating the screws 84 and brackets 82 between various mounting holes 80.

The inwardly facing surface 30 of the elongated front member 22 has an array of blind bores 90 formed therein. Although only three such bores 90 are depicted in FIG. 2 it is contemplated that an array of fifteen or more bores 90 can be employed which are evenly spaced throughout the entire inwardly facing surface 30. An insert 92 formed of ferrous material (e.g., mild steel) is press fit within each bore 90. The décor pieces 40 are formed as relatively thin permanent magnet 94 with an opaque decorative overlay 96. When a décor piece 40 is applied upon the outward facing surface 28 of the front member 22, the magnet 94 at least partially overlays at least a portion of one of the ferrous inserts 92 and are thereby magnetically coupled in place. Similarly, inserts 92 are disposed within blind bores 90 formed in the inner surfaces 34 and 38 of the left and right side members 24 and 26, respectively enabling the application of décor pieces 40 thereto. The inserts 92 are defined as first elements of a magnetic coupling system. The magnet 94 is defined as the second element of the magnetic coupling system.

The number of such insert magnets 94 depends upon the size, weight and number of décor pieces 40 to be employed, the size and type of permanent magnets 94 and ferrous inserts, and the dimensions/proportions of the front and side members 22, 24 and 26, respectively. In principle, there must be a sufficient number of "attachment sites" to ensure that a décor piece 40 will be magnetically coupled to the cornice box 20 wherever it may be randomly positioned. The Applicant believes that a 3×5 array of such attachment sites is satisfactory for a typically sized residential bedroom window.

Figure 3:
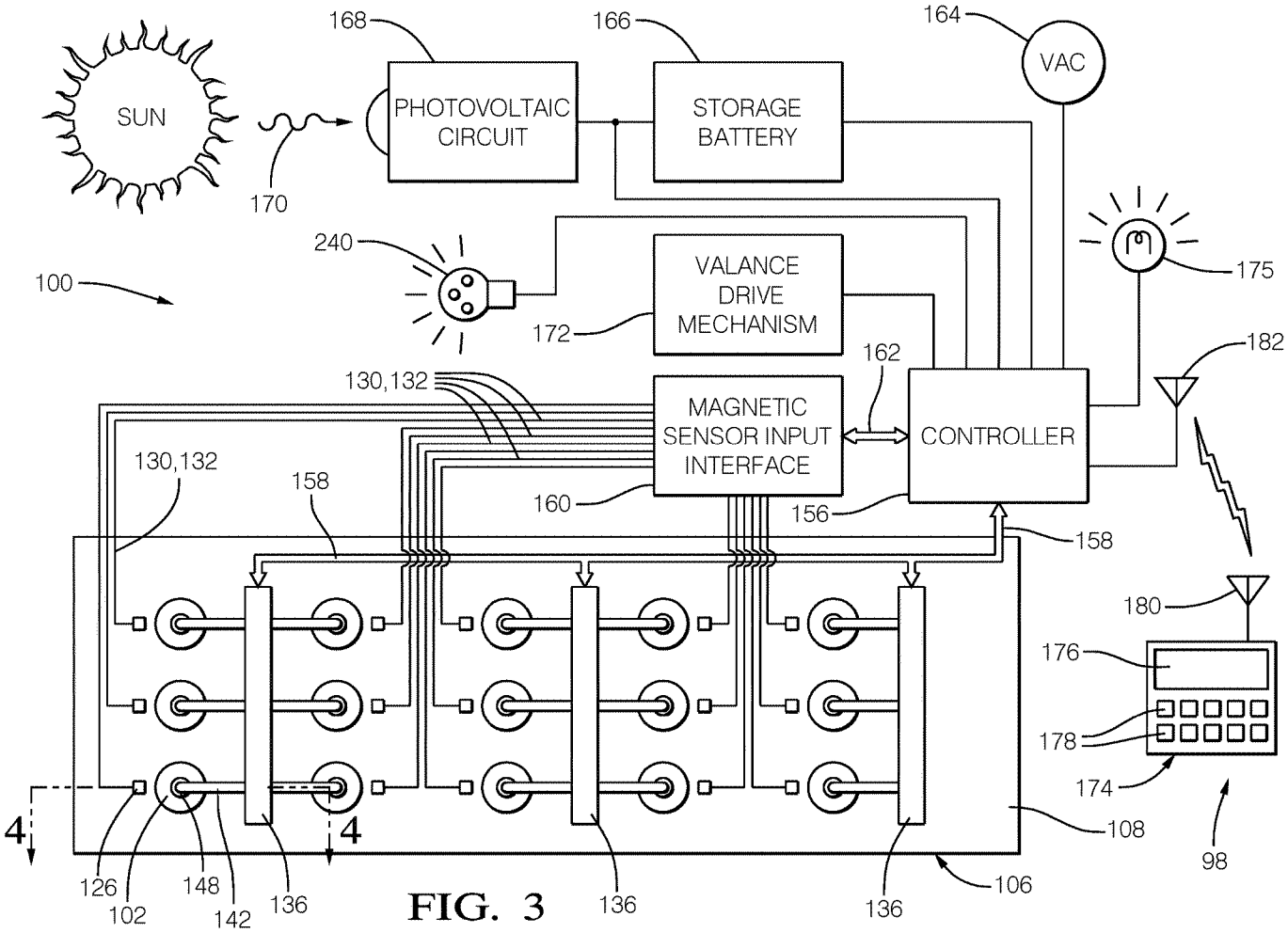
FIG. 3, is a schematic of electrical circuit employed with the reconfigurable cornice box assembly of FIGS. 1 and 2 including a power source and controller operable for selectively illuminating the reconfigurable cornice box assembly and environs.
Figure 4:
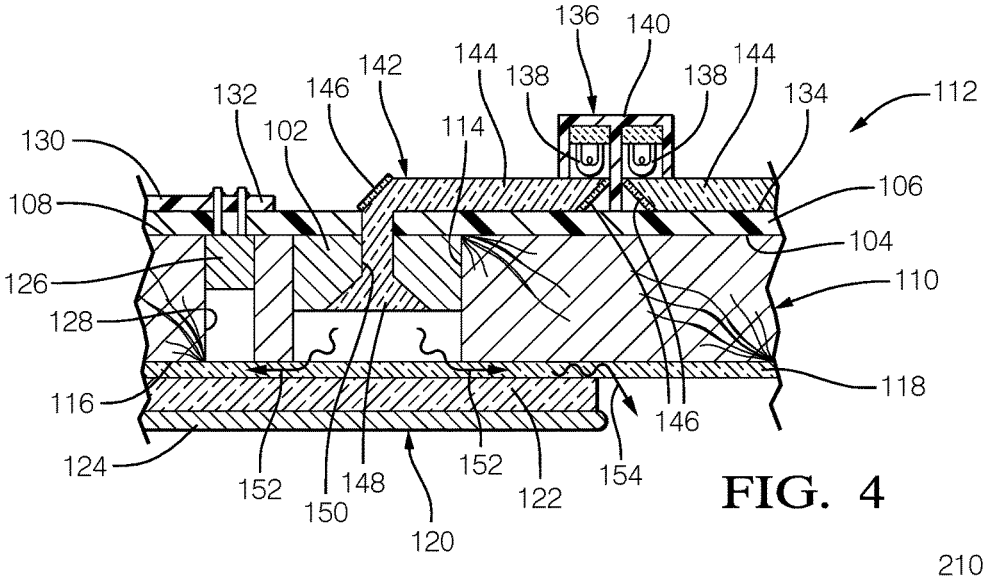
FIG. 4, is a broken, cross-sectional view of one illuminated attachment sight of the cornice box assembly of FIG. 1 on an enlarged scale and removed from the window structure.

Referring to FIGS. 3 and 4, an electronic control system 98 for a reconfigurable cornice box display system 100 includes a 3×5 array of annular ferrous metal inserts 102 bonded upon a forward facing surface 104 of a rectangular substrate 106 or printed circuit board (PCB) dimensioned to dimensionally underlay an inwardly facing surface 108 of an elongated front member 110 and/or side members of a cornice box 112 to which it is applied. FIG. 3 depicts the electronic control system 98 in schematic form with the substrate 106 removed from the cornice box 112 to highlight the details thereof. FIG. 4 depicts a portion of the substrate 106 highlighting a typical single insert 102 in assembly with an associated portion of the cornice box 112 on an enlarged scale.

Referring to FIG. 4, each insert 102 is slip-fit within an associated registering through bore 114 extending between an outwardly facing surface 116 and the inwardly facing surface 108 of the substrate elongated front member 110. A decorative transparent or translucent surface layer 118 is formed on the outwardly facing surface 116 of the elongated front member 110. A décor piece 120 including a shaped permanent magnet 122 covered by an opaque decorative coating 124 is releasable attached at a user selected orientation on the cornice box 112 by the magnetic attraction between at least one of the permanent magnets 122 and at least one adjacent ferrous inserts 102.

A magnetic field sensor 126 associated with each annular insert 102 is disposed within an adjacent through passage 128 extending between the outwardly facing surface 116 and the inwardly facing surface 108 of the substrate elongated front member 110. Each magnetic field sensor 126 includes wire leads extending through vias formed in the substrate 106 which are solder connected to circuit traces 130 and 132 formed on a rearward facing surface 134 of the substrate 106. Each magnetic field sensor 126 functions to sense the magnetic field created by a nearby magnet 122 which has been concentrated by an associated insert. When no décor piece 120 (with associated magnet 122) is present adjacent insert 102, the magnetic field sensor 126 is deactivated. Alternatively, when at least one décor piece 120 (with associated magnet 122) is present adjacent insert 102, the magnetic field sensor 126 is activated. In this manner, the electronic control circuit operates to detect the presence and location of one or more décor pieces 120 anywhere on the outwardly facing surface 116 of the elongated front member 110, and/or the outer surfaces of the side members.

A plurality of LED array modules 136 are affixed to the rearward facing surface 134 of the circuit substrate 106. Each LED array module 136 contains a plurality of discrete electrically actuated LED lights 138 enclosed within a housing 140. Each LED light 138 is interconnected with an associated annular insert 102 via a light pipe system 142 consisting of a light pipe 144, one or more 45 degree reflective guide surfaces 146 and a flared terminus 148 extending through a center passage 150 in annular insert 102. This arrangement is considered as a back light source for the décor pieces 40. The controller 156 includes a microprocessor and memory devices which retain programming instructions/software in memory for operating the electronic control system 98.

Each LED light 138 typically emits light of a single given frequency in the visible light spectrum. Alternatively, each LED light 138 can emit composite light of a plurality of given frequencies (e.x., red, yellow and blue). The addition of an electronic controller can selectively blend/mix the light composite to provide any desired color.

Referring to FIG. 4, when LED light 138 is illuminated, light passes through the light pipe 144, reflecting off reflective guide surfaces 146, and exits the light pipe 144 at the flared terminus 148 as a defocused beam, as illustrated by arrows 152, illuminating the translucent surface layer 118. When partially blocked by the opaque décor piece 120, the defocused beam exits the translucent surface layer 118 about the outer periphery of the décor piece 120, as illustrated by arrow 154, creating a halo effect. The magnetic attachment point illustrated in FIG. 4 is essentially replicated fifteen (15) times in FIG. 3. A greater or lesser number of such magnetic attachment points may be desirable as a function of the dimensions of the cornice box 112 and the size/weight/configuration of the of the décor pieces 120.

Referring to FIG. 3, the substrate 106 of the electronic control system 98 illustrates an array of fifteen (15) annular inserts 102 optically interconnected with one of three (3) LED array modules 136 by an associated light pipe system 142. Each of the LED array modules 136 is electrically interconnected with an electronic controller 156 by an electrical bus system 158. Each of the annular inserts 102 have an adjacent associated magnetic field sensor 126. Each of the magnetic field sensor 126 are electrically interconnected with a magnetic sensor interface circuit 160 which, in turn, is electrically interconnected with the electronic controller 156 via an electrical bus system 162. The electronic control system 98 can be electrically powered by typical 120/240 volt (VAC) household current source 164, a storage or printed battery 166 and/or a photovoltaic, circuit positioned, such as in the window 18 to receive natural sunlight 170.

A valance/blind power drive mechanism 172 is electrically connected to the controller 156 and is selectively actuateable to mechanically reposition the valance 56 and or the blind 54. A power or status indication light 174 electrically connected to the controller 156 can indicate system status to the user of the reconfigurable cornice display system 10. Overall operational control of the reconfigurable cornice display system 10 is affected by a hand-held remote controller 174 containing a display 176 and input devices 178. The electronic circuit system 98 communicates with the remote controller 174 via a radio frequency (RF) link between transmitting/receiving antennas, respectively.

Figure 6:
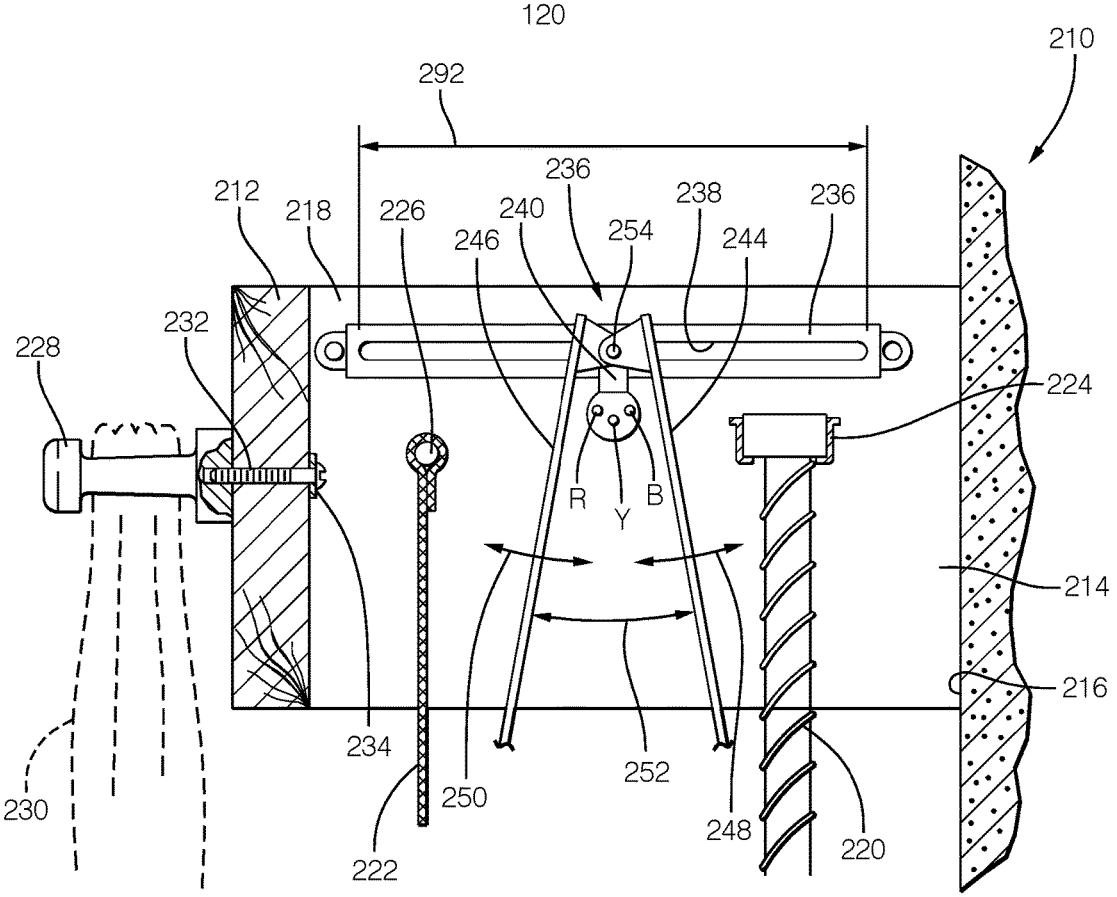
FIG. 6, is a cross-sectional view of the cornice box assembly of FIG. 1 on an enlarged scale illustrating additional features including drapery studs and multi-axis interior mood-type lighting apparatus.
Figure 9:
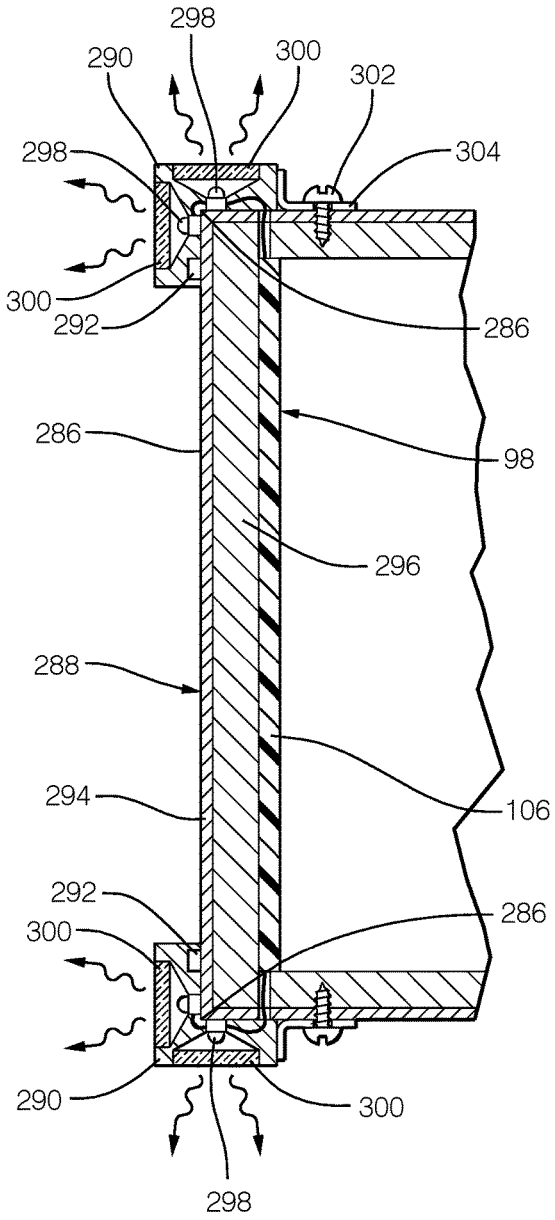
FIG. 9, is a cross-sectional view of a reconfigurable modular edge lighting array applicable with the cornice box assembly of FIG. 1.

The electronic control system 98 is preferably packaged and mounted on the inwardly facing surface 30 of the front member 22 of the cornice box 28. The electronic controller 156 includes a microprocessor, clock, non-volatile memory and multi-function program software. The controller 156 functions to sense the presence of one or more décor piece 128 and activate a related lighting or back illumination device such as illustrated in FIGS. 3, 6 and 9. With a tri-color illumination system as described in relation to FIG. 6, the color of the halo illumination/backlighting can be selected. The time-of-day, ambient light conditions and programmer settings can control the overall functionality of the reconfigurable cornice display system 10.

When a plurality of décor pieces 120 are employed, lights can be illuminated at various locations of the outer surfaces of the cornice box. When lights are not on, the cornice box looks normal such as white or other suitable (e.x., pastel). A step down transformer can be employed to use relatively low voltage throughout the reconfigurable cornice box display system 10. A remote controller 174 or APP installed in a personal portable electronic device will be used to turn on and off various lighting sequences. A power status indicator light 175 is secreted within the system 18 to provide operator feedback. One operating mode is static, meaning that once you place a décor piece 120 that is magnetic to hold to the cornice box 112, then the light behind the décor piece 128 turns on, thus illuminating (e.g., halo and/or backlighting) the décor piece 120 via a magnetic switch 126. Other functions implemented by the electronic control system 98 can be operated in sequences such as random flashing, color choice, fade in and fade out, and the like. Unique décor pieces 256, the décor pieces 40 employed with the light option board, are still magnetically attached, but let light through from light resonating through a décor piece made of some type of material that allows light to pass through it, thus allowing the décor piece to glow on the front side. The light source from the board provides the light for the glow on the front side. The light source from the board provides the light for the glow on the décor piece.

Figure 5:
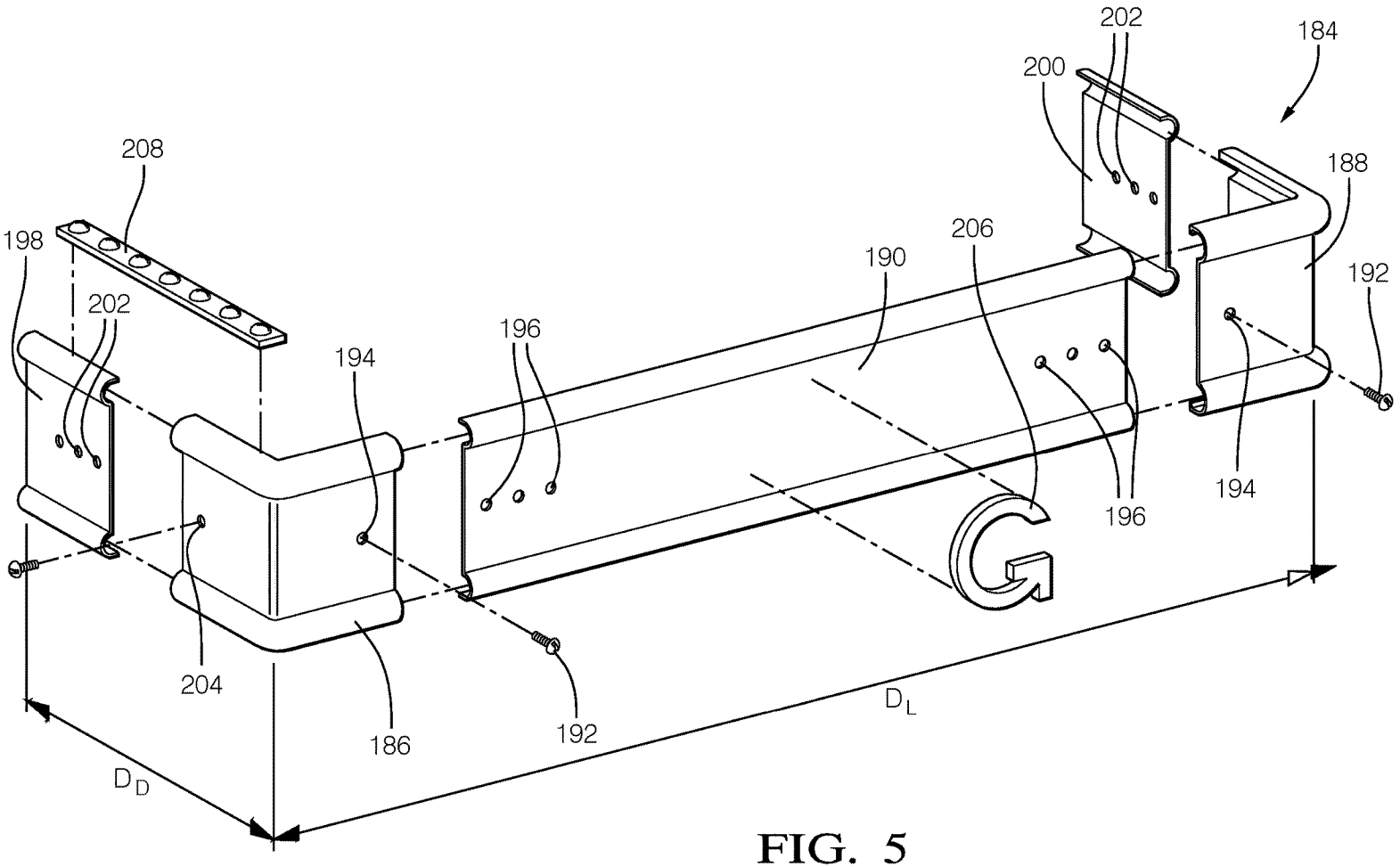
FIG. 5, is an exploded perspective view of the reconfigurable cornice box assembly of FIG. 1, embodying the present invention, wherein the cornice box assembly is longitudinally and laterally dimensionally reconfigurable.

Referring to FIG. 5, a laterally and longitudinally adjustable cornice box 184 is illustrated. The adjustable cornice box 184 includes left and tight cornet members 186 and 188, respectively, telescopingly interconnected by opposed ends of a similarly sectionally shaped front member 190 to establish a desired or predetermined overall lateral width $D_L$ by affixation of suitable fasteners such as screws 192 through selected pairs of preformed mounting holes 194 and 196 of the corner members 186 and 188 and the front member 190, respectively. Similarly, the left and right corner members 186 and 188, respectively, are telescopingly interconnected by opposed ends of similarly sectionally shaped side members 198 and 200 to establish, a desired or predetermined overall longitudinal depth $D_D$ by affixation of suitable fasteners such as screws 192 through selected pairs of preformed holes 202 and 204, respectively. The corner members 186 and 188, the front member 190 and the side members 198 and 200, respectively, can be formed of decorated ferrous metal for magnetically attaching décor pieces 206 and upper/lower strip design elements 208.

Referring to FIG. 6, a cornice box assembly 210 includes an elongated front member 212, a left side member 214 and a right side member (not illustrated). The side members 214 serve to support the front member 212 in a spaced relationship from a support surface 216 to establish a cavity 218 for mounting a blind 220 (e.g., Venetian or accordion type) as well as a decorative valance 222. The cavity 218 is dimensioned to provide adequate clearance spacing between mounting blind 220, valance 222 and the support surface 216.

The blind 220 is supported by brackets 224 affixed to the inner surfaces of the side members 214, and the valance is supported by a tension rod 226 extending between the inner surfaces of the side members 214. A decorative support post 228 extends outwardly from the outer surface of the front member 212 (and potentially from the outer surfaces of the side members 214) to support decorative drapes 230. Support post 228 is affixed to the front member 212 by a suitable through bolt and washer 234.

A cornice lighting system 236 is disposed within the cavity 218 and includes support bracket 236 affixed to one or both of the side members 214 forming a longitudinally elongated adjustment slot 238. A compound light 240 preferably including discrete red, yellow and blue LEDs is mounted for selective sliding displacement along the slot 238 along a line of longitudinal displacement designated by an arrow 242. Repositionable inner and outer light deflectors 244 and 246 are carried for longitudinal displacement with the compound light 240 along the axis of arrow 242. The deflectors 244 and 246 are longitudinally displaceable as a unit with compound light 240 and rotationally repositionable in fixed orientation as illustrated by arrows 248 and 250. Furthermore, each deflector 244 and 246 is separately rotationally repositionable as illustrated by arrow 252. Thus, in addition to the ability of the electronic control system 98 to control the net color and intensity of the illumination of the compound light 240 as illustrated in FIG. 3, the point of origin, angle and spread of focus of the compound light 240 can be adjusted at will. Although a single compound light 240 is illustrated, a laterally extending series of such lights could also be employed. Lastly, a ball mount 254 can support the compound light 240 to enable near omnidirectional focusing and positioning via-a-vis the reflectors 244 and 246, as well as the compound light 240 about a single axis point within the cavity 218 of the cornice box 184.

Figure 8:
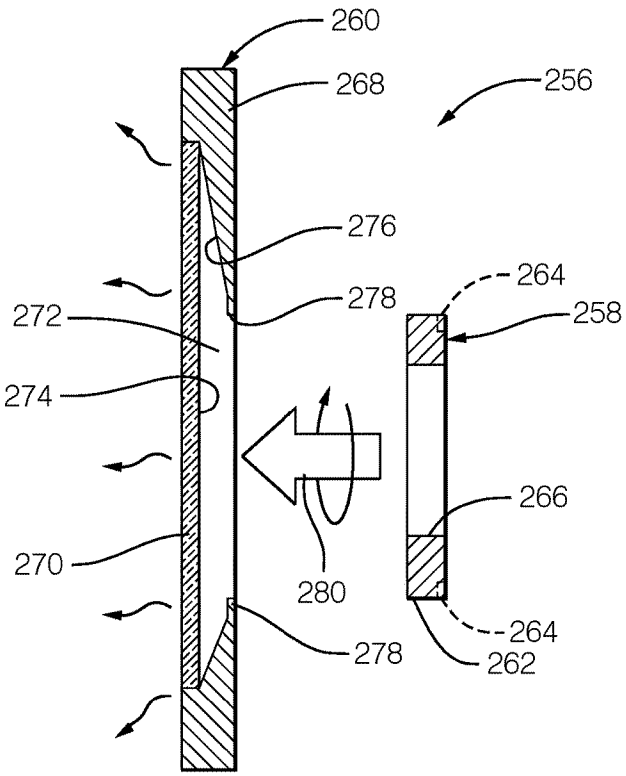
FIG. 8, is an exploded, cross-sectional view of a separately reconfigurable décor piece applicable with the reconfigurable cornice box assembly of FIG. 1.
Figure 7:
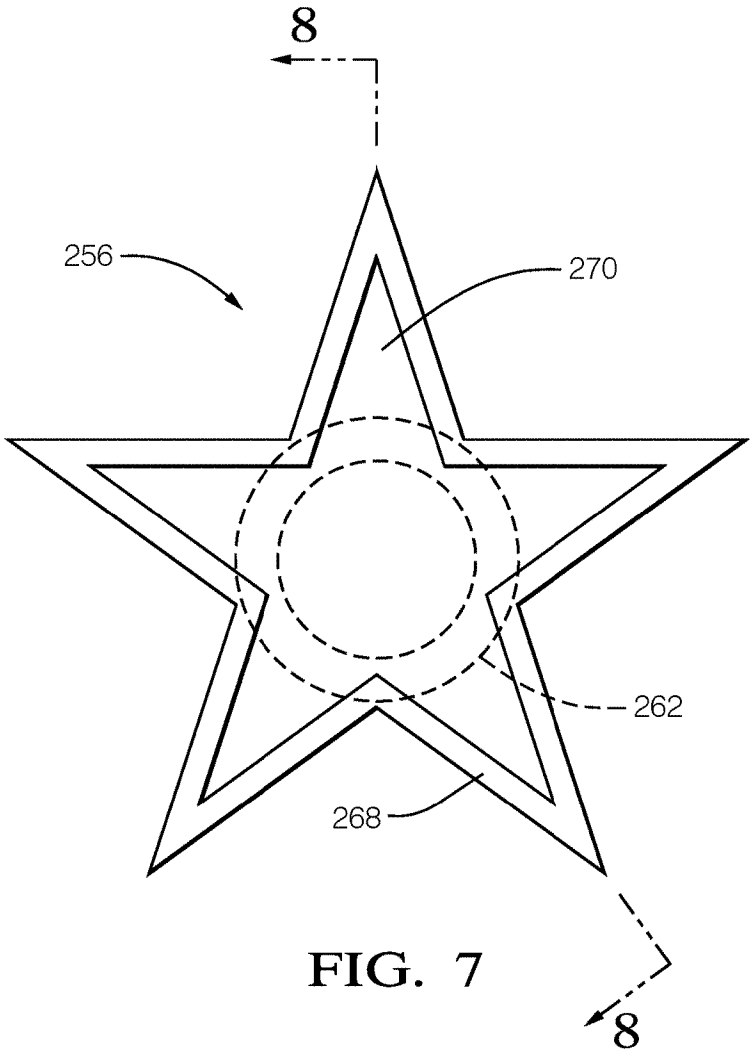
FIG. 7, is an exploded cross-section view of a reconfigurable décor piece and mounting assembly which can be applied with the reconfigurable cornice box assembly of FIG. 1.

Referring to FIGS. 7 and 8, a decorative décor piece 256 includes a generic ring-shaped mounting base 258 comprising either a permanent magnet or a ferrous metal enabling magnetic attachment to the outwardly facing surface 28 consisting of ferrous metal or a permanent magnet, respectively, of the cornice box 20 of FIGS. 1 and 2. The generic ring-shaped mounting base 258 is configured for attachment to a number of alternative design decorative escutcheons 260. The outer peripheral edge 262 of the mounting base 258 defines mounting tab engagement recesses 264. The mourning base 258 forms a large central opening 266 to enable back-lighting of the décor piece 256 by a light pipe system. Refer FIGS. 1 and 2. Alternatively, the décor piece 256 can be self-illuminated, such as with a battery (not illustrated) or illuminated by the associated cornice box 20.

The décor piece 256 includes a decorative escutcheon 260 of a fanciful shape, such as a star formed by an outer peripheral opaque frame portion 268 and an inner transparent/translucent lens 278. The frame portion 268 forms a large tapered central opening 272 exposing the entire inner surface 274 of the lens 270 to rear illumination. The inner portion of the frame 268 has a cone-shaped tapered reflective surface 276 to maximize light dispersal. The tapered surface 276 terminates at a radial inner terminus in integral engagement tabs 278 configured for rotational interlocking engagement with the recesses 254 of the mounting base 258 as illustrated by arrow 280.

Figure 10:
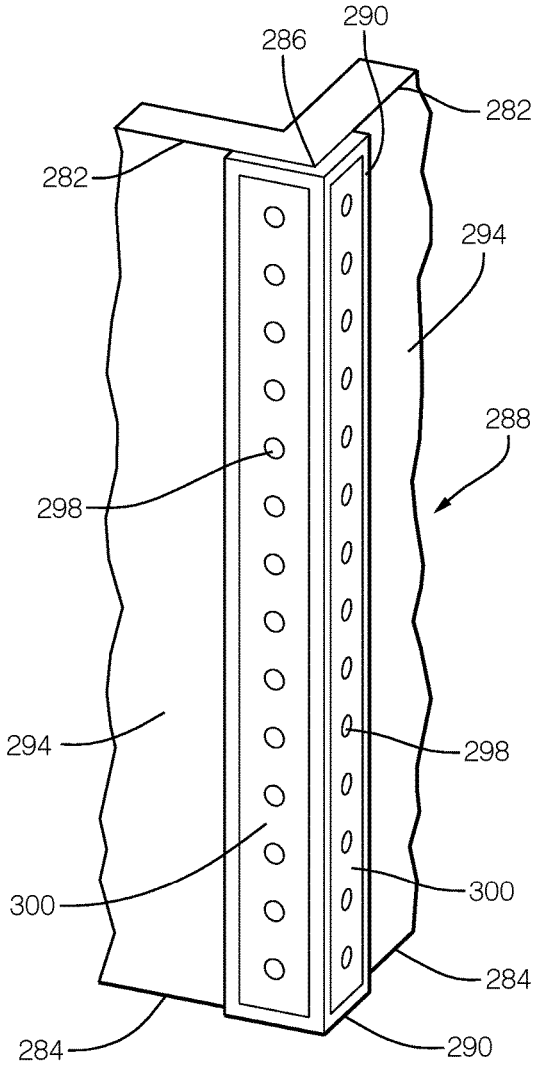
FIG. 10, is a broken perspective of the reconfigurable modular edge lighting array applied with the cornice box assembly of FIG. 1.

Referring to FIGS. 9 and 10, supplemental display edge pieces can be provided along upper, lower or side edges 282, 284 and 284, respectively of a cornice box 188. The cornice box 288 can have a metallic backed surface on all sides except the back. Decorative pieces 298 can be selectively added to the base structure as desired and removed. The decorative pieces 290 can include magnets 292 embedded in them for securing to a metallic hacking 294 the main structure. Decorative pieces 292 can be formed of injection molded plastic, metal, or other suitable rigid material.

The cornice box 288 can be formed of a composite of metallic layer 294 and a rigid non-conductive underlayment 296 configured to support the substrate 106 of the electronic control circuit 98 as described in connection with FIG. 3. The decorative pieces 298 can comprise a simple elongated strip positioned to extend horizontally along the upper and/or lower edges of the front surface, the left and/or right vertical edges of the front surface, along the vertical edges of the front and/or rear left and/or right outer side surfaces, and along the upper and/or lower horizontal edges of the left and/or right outer side surfaces.

Illustrated in FIGS. 9 and 10 are "L" shaped decorative pieces 290 extending vertically along the front left and right edges 286 of the cornice box 288. Each decorative piece 290 has a string of vertically spaced LED lights 298 underlying a vertically elongated translucent (e.g., smoked) lens 300. The LED lights 298 can be mono-colored or multi-colored. And are electrically interconnected to the electronic control system 98. The decorative pieces 290 can be affixed to the cornice box 288 by magnets 292 as described herein above or, alternatively, mechanically attached by hidden mechanical means such as screws 302 extending through associated mounting brackets 304.

A supplemental or mini decorative cornice or extension piece with/without studs for drapery can be affixed to the outer surfaces of the front member 28 and/or the outer surfaces of the left and right side members 24 and 26, respectively, to provide a decorative stepped appearance. This provides an extension/easy hang feature from the wall to adjust overall fit. The extension can hold blinds of all types, as well as shades. It can hold light source for indirect lighting on back. It can hold tension rods for shears/drapes. It holds décor pieces. The décor pieces can light up, either with a battery with LED, solar with battery, external wireless power supply, radio frequency (RF) charging, or magnetic induction power transfer. The décor pieces (pins/small rods) can hold external drapery. Wall mount/side pieces fold over for packaging (hinged or removed) and set by the customer The following documents are deemed to provide a fuller background disclosure of the inventions described herein and the manner of making and using same. Accordingly, each the below-listed documents are hereby incorporated into the specification hereof by reference.

U.S. Pat. No. 2,243,222 to Rebholz entitled "Cornice". h

U.S. Pat. No. 2,315,033 to Adair entitled "Cornice for Windows".

U.S. Pat. No. 2,375,247 to Rebholz entitled "Cornice and Bracket Therefor".

U.S. Pat. No. 2,415,330 to Bashwiner entitled "Draperies and the Like".

U.S. Pat. No. 2,501,133 to Levy entitled "Cornice".

U.S. Pat. No. 2,539,380 to Zimmerman entitled "Cornice".

U.S. Pat. No. 2,602,500 to Slavin Jr. entitled "Ornamental Cornice".

U.S. Pat. No. 2,862,549 to Robbins entitled "Cornice Construction"

U.S. Pat. No. 2,894,571 to Toti entitled "Window Cornice Box Facia".

U.S. Pat. No. 5,032,958 to Harwood entitled "Cornice Lighting System".

U.S. Pat. No. 5,384,519 to Catch entitled "Color Mixing Method for Variable Color Lighting and Variable Color Luminaire for use with the Method".

U.S. Pat. No. 5,484,006 to Walker entitled "Cornice Box".

U.S. Pat. No. 6,603,271 to Noh entitled "Illumination Lamp having Brightness and Color Control".

U.S. Pat. No. 6,877,545 to Parkerson entitled "Foam Cornice Board".

U.S. Pat. No. 7,227,668 to Paul entitled "Method for Producing a Mixed Color Mat is Mixed from Primary Colors and Corresponds to a Prescribed Color Target".

U.S. Pat. No. 9,110,291 to Dominguz-Caballero et al. entitled "Ultra-High Color Mixing and Color Separation".

It is to be understood that the invention has been described with reference to specific embodiments and variations to provide the features and advantages previously described and that the embodiments are susceptible of modification as will be apparent to those skilled in the art.

Furthermore, it is contemplated that many alternative, common inexpensive materials can be employed to construct the basis constituent components. Accordingly, the forgoing is not to be construed in a limiting sense.

The invention has been described in an illustrative manner, and it is to be understood that the terminology, which has been used is intended to be in the nature of words of description rather than of limitation.

Obviously, many modifications and variations of the present invention are possible in light of the above teachings. For example, the ferrous inserts depicted as mounted within the cornice boxes and the permanent magnets depicted as mounted with associated décor pieces could be substituted whereby permanent magnets can be as mounted within the cornice boxes and the ferrous members can be mounted with associated décor pieces. Alternatively, the entire front and side members could be composed of overlain with elongated strips or full dimension surface panels composed of ferrous material or permanent magnets. It is, therefore, to be understood that within the scope of the appended claims, wherein reference numerals are merely for illustrative purposes and convenience and are not in any way limiting, the invention, which is defined by the following claims as interpreted according to the principles of patent law, including the Doctrine of Equivalents, may be practiced otherwise than is specifically described.

The invention claimed is:

1. A reconfigurable modular cornice box display system comprising:

a cornice box including a front member forming an outwardly facing display surface;

at least one décor piece adapted for selective positioning on and releasable affixation to said display surface; and a magnetic coupling system comprising a first element carried with said cornice box and a second element carried with the said at least one décor piece, wherein said first element is substantially co-extensive with said outwardly facing display surface to effect magnetic coupling of said décor piece upon any location of said outwardly facing display surface.

2. The reconfigurable modular cornice box display system of claim 1, wherein said first element comprises an array of spaced apart discrete elements embedded within said front member.

3. The reconfigurable modular cornice box display system of claim 2, further comprising a décor piece illumination system comprising a back light source and a magnetic sensor associated with each of said discrete elements operative to sense the magnetic coupling of a given décor piece to a given discrete element and to back illuminate said given décor piece in response thereto.

4. The reconfigurable modular cornice box display system of claim 3, further comprising an electronic control system operable to selectively activate said décor piece illumination system in response to operator inputs and microprocessor based programming instructions.

5. The reconfigurable modular cornice box display system of claim 3, wherein said electronic control system further comprises a solar energy collection and storage system.

6. The reconfigurable modular cornice box display system of claim 5, wherein said cornice box front member and side walls are dimensionally adjustable.

7. The reconfigurable modular cornice box display system of claim 3, wherein said electronic control system further comprises a remote multi-function control device including operator inputs and displays.

8. The reconfigurable modular cornice box display system of claim 3, wherein said back light source further comprises a hi-color light source operable to selectively vary the color of light emitted therefrom.

9. The reconfigurable modular cornice box display system of claim 1, wherein said first element comprises a sheet of ferrous metal and said second element comprises a discrete permanent magnet carried by each décor piece.

10. The reconfigurable modular cornice box display system of claim 1, wherein said first, element comprises an array of spaced apart permanent magnets and said second element comprises a discrete ferrous metal element carried by each décor piece.

11. The reconfigurable modular cornice box display system of claim 1, wherein said first element comprises an array of spaced ferrous metal inserts and said second element comprises a discrete permanent magnet carried by each décor piece.

12. The reconfigurable modular cornice box display system of claim 1, wherein said outwardly facing display surface comprises a forward surface and laterally opposed side surfaces.

13. The reconfigurable modular cornice box display system of claim 12, wherein said flood light assembly further comprises independently adjustable front and rear independently repositionable reflectors.

14. The reconfigurable modular cornice box display system of claim 12, wherein said flood light assembly further comprises a tri-color light source operable to selectively vary the color of light emitted therefrom.

15. The reconfigurable modular cornice box display system of claim 12, wherein said tri-color light source is operable to emit light of red, yellow and blue frequencies and combined mixtures thereof.

16. The reconfigurable modular cornice box display system of claim 12, wherein said electronic control system comprises a substrate which supports said first element of the magnetic coupling system, said magnetic sensors and said décor piece illumination system.

17. The reconfigurable modular cornice box display system of claim 1, wherein said at least one décor piece comprises a transparent or translucent lens portion.

18. The reconfigurable modular cornice box display system of claim 1, further comprising a flood light assembly disposed within said cornice box which is longitudinally and rotationally repositionable.

19. A reconfigurable modular corn cornice box display system comprising:

a cornice box including a front member, a left member and a right member collectively forming an outwardly facing display surface;

at least one décor piece selectively positioned and releasably affixed to said display surface;

a magnetic coupling system comprising an array of first elements carried with said cornice box and a second element carried with said at least one décor piece, wherein said first elements are substantially co-extensive with said outwardly facing display surface to effect magnetic coupling of said décor piece upon any location of said outwardly facing display surface;

a décor piece illumination system comprising a back light source and a magnetic sensor associated with each of said discrete elements operative to sense the magnetic coupling of a given décor piece to a given discrete element and to back illuminate said given décor piece in response thereto;

an electronic control system operable to selectively activate said décor piece illumination system in response to operator inputs and microprocessor based programming instructions; and a flood light assembly disposed within said cornice box which is longitudinally and rotationally repositionable.

* * * * *